United States Patent [19]

Cuccio

[11] Patent Number: 4,770,649

[45] Date of Patent: Sep. 13, 1988

[54] BRUSH-TYPE SOAP GATHERING AND BUBBLE BLOWING DEVICE

[76] Inventor: John D. Cuccio, 820 N. Signal St., Ojai, Calif. 93023

[21] Appl. No.: 26,541

[22] Filed: Mar. 17, 1987

[51] Int. Cl.[4] ..... A63H 33/28

[52] U.S. Cl. ..... 446/15; D4/116; 401/291

[58] Field of Search ..... 446/15, 16, 19, 171; 15/184; 401/126, 129, 130, 262, 265, 266, 269, 288, 291

[56] References Cited

U.S. PATENT DOCUMENTS

| | | | |
|---|---|---|---|
| 1,115,556 | 11/1914 | Little | 446/19 |
| 1,576,287 | 3/1926 | Larsen | 446/19 |
| 1,617,569 | 2/1927 | Boyle | 401/291 |
| 1,646,398 | 10/1927 | Gaffin | 446/19 |
| 2,514,009 | 7/1950 | Raspet | 446/15 |
| 2,582,552 | 1/1952 | Marco | 15/171 |
| 2,711,051 | 6/1955 | Pick | 446/19 |
| 2,825,080 | 3/1958 | Bongioranni | 401/288 |
| 3,109,255 | 11/1963 | Hein | 446/15 |
| 3,443,337 | 5/1969 | Ehrlich | 446/19 |
| 3,589,822 | 6/1971 | Manuel | 401/291 |
| 3,950,887 | 4/1976 | Kort | 446/15 |
| 3,952,447 | 4/1976 | Hackell | 446/19 |
| 4,252,455 | 2/1981 | de la Pena | 401/288 |
| 4,447,169 | 5/1984 | Vartoughian | 401/126 |
| 4,447,982 | 5/1984 | Gushea | 446/16 |

FOREIGN PATENT DOCUMENTS

| | | | |
|---|---|---|---|
| 276744 | 4/1952 | Switzerland | 446/16 |
| 1509848 | 5/1978 | United Kingdom | 446/16 |

*Primary Examiner*—Robert A. Hafer
*Assistant Examiner*—Charles H. Harris
*Attorney, Agent, or Firm*—Gene W. Arant

[57] ABSTRACT

A soap-solution gathering and bubble blowing device includes a rigid base member having a central opening or air passageway therethrough, and a hollow brush which is supported from the base member and provides an extension of the air passageway.

In use, the base member is moved over an open-topped vessel filled with a soap solution, and the bristle members are dipped into the solution in order to fill the spaces between them by capillary action. The bristle members may be bent of flexed against the bottom or side wall of the vessel while the spaces are being filled.

5 Claims, 1 Drawing Sheet

BRUSH-TYPE SOAP GATHERING AND BUBBLE BLOWING DEVICE

BACKGROUND OF THE INVENTION

Bubble blowing devices are well known in the prior art and have generally been used for amusement or decoration purposes. Generally speaking, the bubble blowing device is dipped into an open-topped vessel containing a soap solution in order to acquire a supply of soap. Then bubbles are blown from the thus-acquired soap supply.

It is well known, for example, to utilize a ring-shaped device for this purpose. In the dipping operation a surface layer of soap solution is gathered on the surface of the ring, and in addition, a film of soap will extend across the central opening of the device. Air is then blown against that soap film and through the opening causing a series of soap bubbles to form, the first bubble being formed directly from the original film, but as succeeding bubbles are blown the surface layer of soap solution on the ring-shaped device being drawn off to replenish the film across the opening.

The present invention relates to a device for drawing off larger quantities of soap from an open topped vessel, and for making it possible for the user of the device to effectively utilize those larger quantities of soap by blowing larger bubbles as well as by blowing more bubbles in a particular series.

Pertinent prior art United States patents include the following:

Gaffin, U.S. Pat. No. 1,646,398, 1927
Pick, U.S. Pat. No. 2,711,051, 1955
Hein, U.S. Pat. No. 3,109,255, 1963
Kort, U.S. Pat. No. 3,950,887, 1976
Gushea, U.S. Pat. No. 4,447,982, 1984

Both Kort and Gushea show serrated or slitted members with spaces for retaining extra amounts of a soap solution.

Thus the object of the invention is to provide an improved bubble dispenser which also has an increased capacity for picking up and storing the soap solution from which the bubbles are formed, and which will therefore blow both larger bubbles and a greater number of bubbles.

SUMMARY OF THE INVENTION

According to the present invention the soap gathering and bubble blowing device is made in the form of a hollow brush attached to a rigid base member having a central opening therein. The brush has a multitude of bristle members which form an extension of that central opening. More specifically, the bristle members are arranged about the central opening and attached to the base member, there being a sufficient number of the bristle members so that the extended central opening is bounded by a wall having a radial thickness of at least several bristle members.

In use, not only may the device of the present invention be dipped in an open-topped container, but the bristle members may also be flexed against the bottom or side wall of the container in order to ensure a full pick-up of soap. As the bristle members are flexed the distance between bristle members changes—thus, the capillary action involved in filling the brush is not just a function of a fixed space between adjacent bristle members, but is produced as a result of the variable spacings that occur during the flexing action.

DRAWING SUMMARY

DETAILED DESCRIPTION

Figure 1:
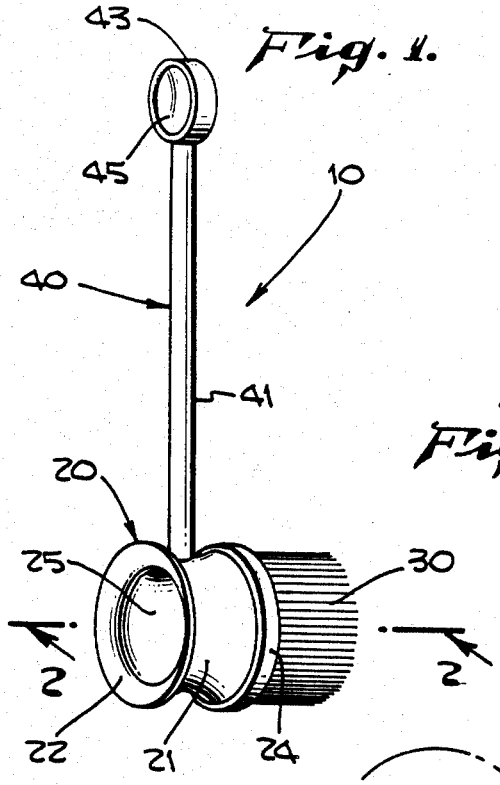
FIG. 1 is a perspective view of a presently preferred form of my new soap gathering and bubble blowing device.
Figure 4:
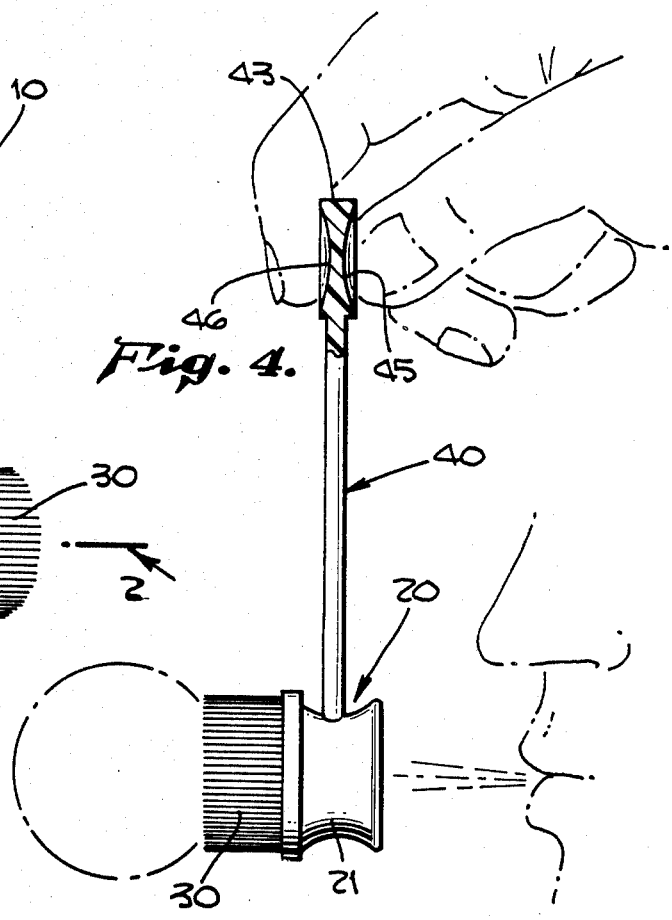
FIG. 4 is a side elevation view illustrating the blowing of bubbles with my device.

Referring now to the drawings, FIG. 1 is a perspective view of one presently preferred form of my novel device. The device 10 includes a base member 20 having a central opening 25 for the passage of air therethrough, and a hollow brush 30 protruding from one side of the base member. A handle 40 is attached to base member 20.

More specifically, base member 20 is of generally ring-shaped configuration. Its axial length is typically about three-fourths of an inch and its exterior diameter about one and one-fourth inches. Its wall structure is designated by numeral 21 and its inner or near end by numeral 22 while its outer or remote end is designated by numeral 23. The radial thickness of wall 21 may typically be about three-sixteenths of an inch. In the embodiment as shown the wall structure 21 is not cylindrical, but instead is curved throughout most of its length so that it is of smaller diameter at about the midpoint of its length while its two ends are of the same exterior diameter.

Adjacent the output end 23 of base member 20 the wall 21 has a thickened portion 24 and is also straight on its interior surface—that is, the central opening 25 is of slightly less diameter at output end 23 than it is at input end 22, and is compressed to much smaller diameter at its longitudinal center because of the previously mentioned curvature of the wall 21. The straight portion of central opening 25 inside the wall portion 24 at the output end of the base member 20 is designated by numeral 27.

Figure 2:
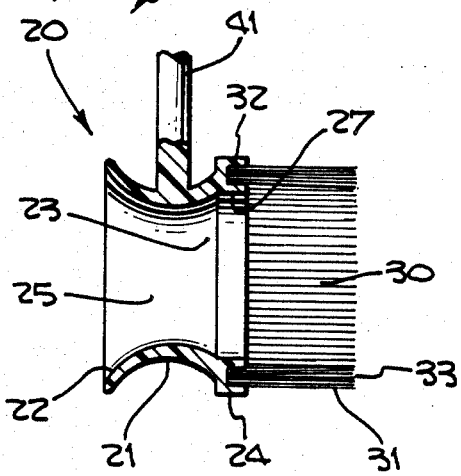
FIG. 2 is a cross-sectional view taken on the line 2—2 of FIG. 1.

A hollow brush 30 consists of a multitude of bristle members 31. Bristle members 31 have inner or near ends 32 which are encapsulated or embedded within the thickened portion 24 of wall 21. They are all arranged parallel to each other and to the straight portion 27 of central opening or air passageway 25 so as to provide an extension of that air passageway. Also, there are a sufficient number of the bristle members so that the radial thickness of brush 30 is at least several bristle members. This is shown in FIG. 2 which shows a radial thickness of five bristle members.

It should be understood, however, that the arrangement of the bristle members is preferably somewhat random, so that at one point on the circumference of the hollow brush the thickness may be five bristle members, but at other points it may be as little as three or as many as seven or even more. Spaces 35 provided between the bristle members are somewhat uniform, but not precisely so.

The remote or outer ends of the bristle members are designated by numeral 33. The projecting lengths of all bristle members are preferably equal, so that a soap bubble when blown will sever itself from all bristle members at the same time. The projecting length of the bristle members is at least about one-half inch, and preferably about three-fourths of an inch.

The bristle members are preferably made of a resilient plastic material. This enhances their ability to bend or flex. It also provides a surface tension characteristic which will accommodate various kinds of commercially available soap solutions and improve the capillary action by which the soap solution is picked up and stored between the bristle members.

Handle 40 includes an elongated rod portion 41 which is attached to base member 20 at one point on the circumference thereof, and a finger piece 43 at the remote end of the rod. The finger piece is of generally ring-shaped configuration but relatively thin, to provide easy grasping between two fingers of the user's hand. Preferably, as shown, the finger piece has concavely hollowed side surfaces 45, 46, to facilitate easy finger gripping action.

In fabricating the device, handle 40 with its rod portion 41 and finger piece 43 is preferably formed integral with the base member 20. A plastic material is preferred since this conveniently accommodates the embedding of the inner ends 32 of the bristle members 31.

Figure 3:
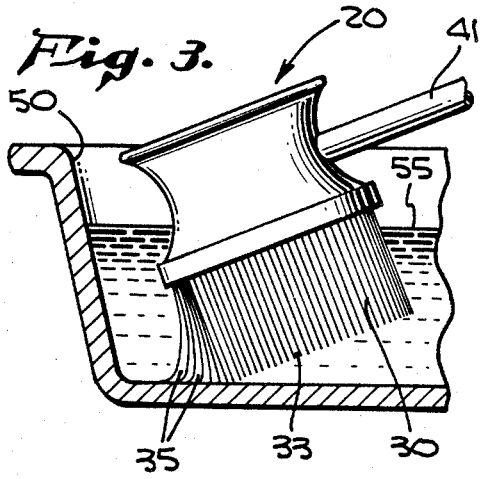
FIG. 3 is a side elevation view, in cross-section, showing my device when in use gathering soap solution from a vessel.

In use, base member 20 is moved toward an open-topped vessel 50 (see FIG. 3) which is filled with a soap solution 55. The outer ends of the bristle members 31 are dipped into the soap solution, permitting the soap solution to rise by capillary action and fill the spaces 35 between bristle members. The bristle members may also, if so desired, be flexed or bent as shown in FIG. 3. This action has two advantages. One is to pick up all of the soap solution from the bottom wall of vessel 50—this not only results in full use of the soap solution but provides the convenience of an empty vessel when the bubble blowing is over. A second advantage of flexing the bristle members is that it varies the spaces 35 between bristle members, thus enabling the capillary action to be varied accordingly.

MODIFIED FORMS

While the base member 20 has been shown herein as being of ring-shaped or circular cross-sectional configuration, it may if desired be elliptical, rectangular, or of other desired cross-section.

In the presently preferred embodiment a handle 40 is provided, but the brush-type soap gathering and dispensing device of the present invention may if desired be incorporated into a machine which includes means for supporting the base member and periodically moving it so as to dip the bristle members into a soap solution. In other words, the base member instead of being manipulated by hand may be controlled by a machine action, in a manner that is known in the art.

While the invention has been described in detail in its presently preferred form, it will be understood that such detailed description is provided in order to comply with the patent laws, and that the breadth and scope of the invention is to be measured only by the appended claims.

What I claim is:

1. A brush-type soap gathering and bubble blowing device comprising:

a rigid base member having a central air passageway therethrough, said air passageway having an input end and an output end, said air passageway being substantially straight adjacent its output end; a multitude of generally identical bristle members at said output end of said air passageway, each said bristle member having rearward and forward ends, the rearward ends of all of said bristle members being rigidly attached to said base member and all of said bristle members extending substantially parallel to said straight portion of said air passageway in circumdisposed relation thereto, thus forming an extended air passageway;

said bristle members forming a circumferential wall about said extended air passageway, said wall having a radial thickness of at least several bristle members;

all of said bristle members being made of a resilient plastic material and having a projecting length of at least about one-half inch; and means secured to said base member both for dipping said bristle members into a soap solution whenever soap is to be gathered, and for holding said base member in an elevated position whenever air is to be blown into the input end of said air passageway for causing bubbles to be blown from the soap stored in said bristle members.

2. The device of claim 1 wherein said base member is of generally annular configuration and both said air passageway and said extended air passageway are of substantially circular cross-sectional configuration.

3. The method of blowing soap bubbles comprising the steps of:

selecting a generally ring-shaped base member with an opening therethrough;

selecting a multitude of bristle members made of a resilient plastic material and having a length of at least about one-half inch;

positioning the bristle members in a circular pattern so as to form a cylinder with the wall thereof having a thickness of at least several bristles;

attaching one end of all the bristle members to one side of the base member so that said cylinder provides an extension of the base member opening;

dipping the bristle members into a soap solution so as to store a quantity of soap between bristles; and after lifting the bristle members from the soap solution, blowing air into the other end of said base member opening so that the stored soap forms a series of bubbles.

4. The method of gathering a quantity of soap and blowing soap bubbles therefrom, comprising the steps of:

selecting a brush-type bubble blower having a rigid base member with a central opening therethrough and a hollow brush consisting of a multitude of bristle members mounted on one side of said base member to provide a circumferential wall which forms an extension of said central opening, the bristle members being made of a resilient material;

selecting an open-topped vessel filled with a soap solution;

moving the base member towards the vessel to dip the bristle members into the soap solution and thus acquire by capillary action a quantity of soap which fills the spaces between bristle members;

lifting the bristle members out of the soap solution; and then blowing air from the other side of said base member through said central opening so as to generate a series of bubbles from the remote ends of the bristle members.

5. The method of claim 4 which includes the additional step of flexing the bristle members against a bottom or side wall of the soap vessel so as to vary the spacing between bristle members while the capillary action is taking place.

* * * * *